US009275628B2

(12) United States Patent
Schnitta et al.

(10) Patent No.: US 9,275,628 B2
(45) Date of Patent: Mar. 1, 2016

(54) TUNABLE FREQUENCY ACOUSTIC STRUCTURES

(76) Inventors: Bonnie S. Schnitta, East Hampton, NY (US); Roy S. Freedman, New York, NY (US)

( * ) Notice: Subject to any disclaimer, the term of this patent is extended or adjusted under 35 U.S.C. 154(b) by 1523 days.

(21) Appl. No.: 12/435,755

(22) Filed: May 5, 2009

(65) Prior Publication Data

US 2009/0285432 A1 Nov. 19, 2009

Related U.S. Application Data

(60) Provisional application No. 61/050,459, filed on May 5, 2008.

(51) Int. Cl.

| | |
|---|---|
| ***H04R 1/02*** | (2006.01) |
| ***G10K 11/16*** | (2006.01) |
| ***G10K 11/00*** | (2006.01) |
| ***G10K 11/178*** | (2006.01) |

(52) U.S. Cl.
CPC ..... *G10K 11/178* (2013.01)

(58) Field of Classification Search
CPC ..... G10K 11/178
USPC ..... 181/224, 226, 198, 255, 252, 18, 22, 181/175, 195, 295, 156; 381/353, 354, 381/71.3, 71.5, 71.7
See application file for complete search history.

(56) References Cited

U.S. PATENT DOCUMENTS

| | | | | |
|---|---|---|---|---|
| 326,568 | A * | 9/1885 | Kessel | 181/22 |
| 694,825 | A * | 3/1902 | Boyd | 181/22 |
| 739,541 | A * | 9/1903 | Greis | 181/22 |
| 3,997,020 | A | 12/1976 | Busnel et al. | |
| 4,366,882 | A | 1/1983 | Parker | |
| 5,283,398 | A | 2/1994 | Kotera et al. | |
| 5,377,534 | A * | 1/1995 | Boet | 73/112.01 |
| 5,511,127 | A * | 4/1996 | Warnaka | 381/71.5 |
| 5,771,851 | A | 6/1998 | McLean | |
| 5,821,471 | A * | 10/1998 | McCuller | 181/156 |
| 5,930,371 | A | 7/1999 | Cheng et al. | |
| 6,508,331 | B1 | 1/2003 | Stuart | |
| 6,634,457 | B2 | 10/2003 | Paschereit et al. | |
| 6,705,428 | B2 | 3/2004 | Kudernatsch | |
| 6,792,907 | B1 | 9/2004 | Kostun et al. | |

(Continued)

OTHER PUBLICATIONS

M.R.F. Kidner, B.S. Cazzalato. "An Adaptive Chimney Stack Noise Control". Acoustics 2005: Acoustics in a Changing Environment: Proceedings of the Annual Conference of Australian Acoustical Society. Nov. 2005. Terrance McMinn (ed.): pp. 159-163.

(Continued)

*Primary Examiner* — Elvin G Enad
*Assistant Examiner* — Ronald Hinson
(74) *Attorney, Agent, or Firm* — John F. Vodopia

(57) ABSTRACT

An acoustic structure and a method for dampening sound. The acoustic structure includes an acoustic absorber having one or more acoustic elements. The acoustic absorber is disposed inside a volume. The acoustic structure further includes an acoustic radiator having one or more acoustic elements. The acoustic radiator is disposed outside the volume. A cross-sectional area of the one or more acoustic elements decreases with a distance from a mouth of the one or more acoustic elements to a throat of the one or more acoustic elements. The acoustic structure also includes one or more acoustic waveguide ducts configured to acoustically couple the acoustic absorber and the acoustic radiator.

35 Claims, 8 Drawing Sheets

(56) References Cited

U.S. PATENT DOCUMENTS

| | | | | |
|---|---|---|---|---|
| 6,915,876 | B2 | 7/2005 | Ciray | |
| 6,963,647 | B1 | 11/2005 | Krueger et al. | |
| 7,068,805 | B2 | 6/2006 | Geddes | |
| 7,317,801 | B1 | 1/2008 | Amir | |
| 2004/0066940 | A1 | 4/2004 | Amir | |
| 2004/0194776 | A1 | 10/2004 | Amir | |
| 2007/0003071 | A1 | 1/2007 | Slapak et al. | |
| 2007/0215407 | A1* | 9/2007 | Chiang | 181/156 |
| 2007/0223715 | A1 | 9/2007 | Barath et al. | |

OTHER PUBLICATIONS

Sarabjeet Singh, Colin H. Hansen and Carl Q. Howard. "The Elusive Cost Function for Tuning Adaptive Helmholtz Resonators", Proceedings of the First Austral-Asian Acoustical Societies' Conference: Acoustics 2006: Noise of Progress. New Zealand, Nov. 2006. Terrance McMinn (ed.): pp. 75-82.

Colin H. Hansen. "Sensors and Actuators for Active Noise Control Systems". Acoustics Australia 34 (2), Aug. 2006, pp. 79-84.

Paso Partners. "The Five Senses-Lesson 3: Hearing" —Activity—Talking Tubes. Integrating Mathematics, Science and Language: An Instructional Program. 2008 www.sedl.org/scimath/pasopartners/senses/lesson3a2.html.

C. Kosanetzky, "Little boy sticking his head into the funnel of an intercom in a playground," Mar. 31, 2006, http://www.tradebit.com/filedetail.php/2478332v1027421-little-boy-sticking-his-head-into-the Thomas, John. "Kid Concoctions & Contraptions," B&H Publishing, Nashville, Tennessee, 2006, pp. 48-49.

* cited by examiner

TUNABLE FREQUENCY ACOUSTIC STRUCTURES

CROSS-REFERENCE TO RELATED APPLICATION

This application is based on and derives the benefit of the filing date of U.S. Provisional Application No. 61/050,459, filed May 5, 2008. The entire contents of this application is herein incorporated by reference in its entirety.

FIELD OF THE INVENTION

The present invention relates generally to sound modifying structures and more particularly to frequency tunable acoustic structures.

DESCRIPTION OF EMBODIMENTS OF THE INVENTION

Figure 1:
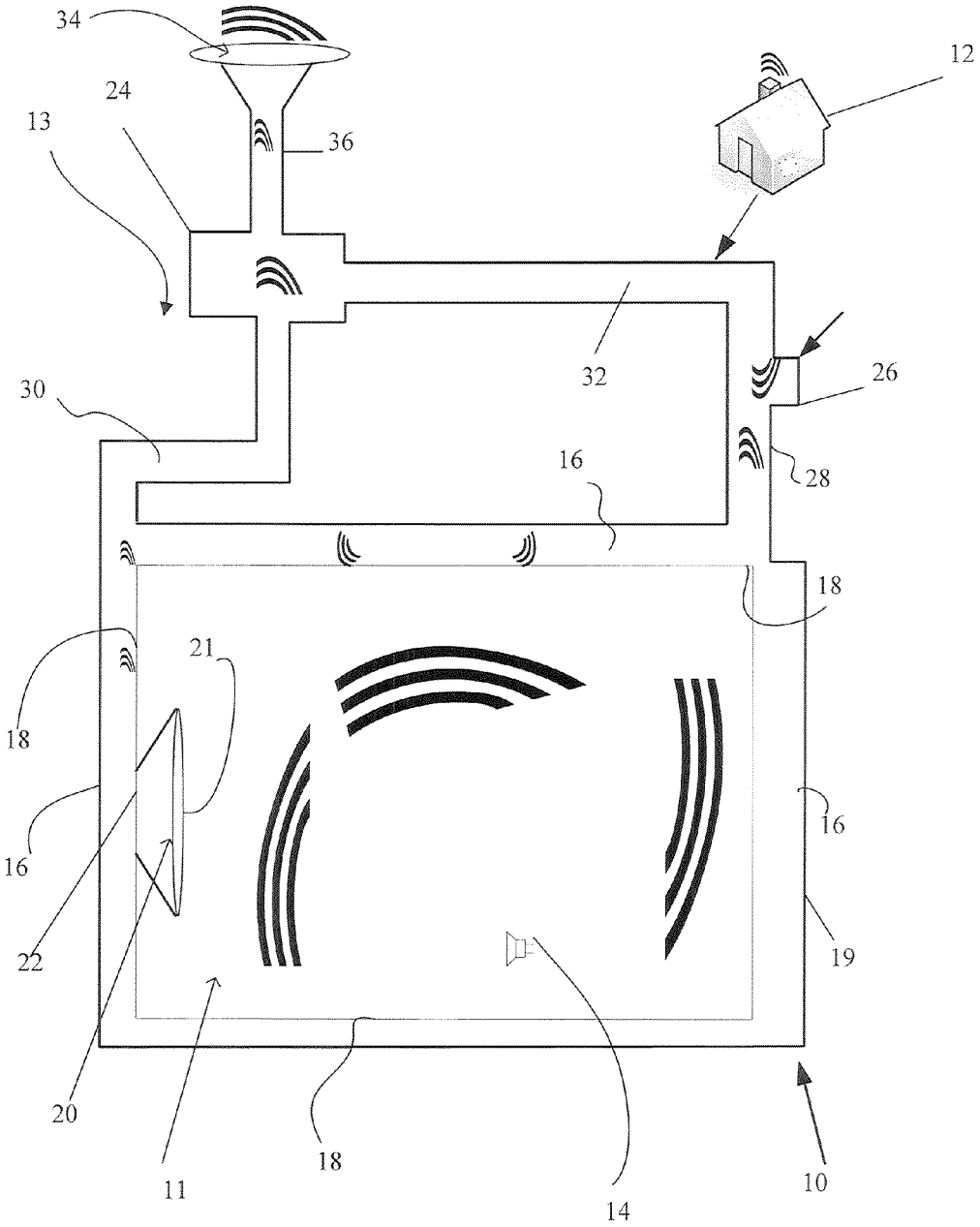
FIG. 1 shows a schematic view of a room having an acoustic structure for mitigating low frequency sound, according to an embodiment of the present invention.

FIG. 1 shows a schematic view of a room using an acoustic structure for mitigating low frequency sound, according to an embodiment of the present invention. A room 10 in a building 12 includes a sound source 14, such as, but not limited to, sound speakers or other sound emitting devices. The room 10 can be, for example, in a dwelling or other building. The room 10 also includes an acoustic structure 13. The acoustic structure 13 in the room 10 includes one or more acoustic waveguide ducts 16. The acoustic waveguide ducts 16 are located between internal walls 18 defining a room 11 that can be acoustically isolated and external walls 19 defining the room 10. Hence, the room 11 can be seen as a room within the room 10. The acoustic structure 13 also includes an acoustic absorber or an acoustic fireplace 20. In one embodiment, the acoustic fireplace 20 is a cone-shaped or horn-shaped structure having its wider mouth 21 oriented towards an interior of the room 11. The acoustic fireplace 20 is connected to one of the acoustic waveguide ducts 16 through a narrower end 22 of the acoustic fireplace 20.

In one embodiment, the acoustic structure 13 also includes an acoustic frequency filter 24. The acoustic frequency filter 24 can be, for example, a frequency tunable Helmholtz resonator. In one embodiment, the acoustic structure 13 may further include a tunable anti-noise source 26. The tunable anti-noise source 26 may be phase tunable, for example. The tunable anti-noise source 26 is acoustically coupled to the acoustic waveguide duct 16 though acoustic waveguide duct 28. The acoustic frequency filter 24 is acoustically coupled to the acoustic waveguide duct 16 through acoustic waveguide duct 30. The tunable anti-noise source 26 can also be acoustically coupled to acoustic frequency filter 24 via acoustic waveguide duct 32.

The acoustic structure 13 further includes an acoustic chimney 34. The acoustic chimney 34 is acoustically coupled to the acoustic frequency filter 24 through acoustic waveguide duct 36. In one embodiment, the acoustic chimney 34 is a cone-shaped or horn-shaped acoustic radiator. The acoustic radiator 34 (and acoustic fireplace 20) can be for example a zero impedance exponential horn which will be explained in further details in the following paragraphs. Although, the acoustic chimney 34 is depicted in FIG. 1 being coupled to acoustic frequency filter 24, the acoustic chimney 34 can also be directly coupled to acoustic waveguide duct 16, for example via waveguide ducts 30 and 36.

In operation, sound is emitted by the sound source 14. A portion of the sound generated by the sound source 14 can be absorbed by the acoustic fireplace 20. The sound absorbed by the acoustic fireplace 20 propagates through the acoustic waveguide ducts 16, 28, 30, 32 and 36 to end at the acoustic chimney 34 where it can be radiated outside the building 12 into the atmosphere. The ducts 16, 28, 30, 32 and 36 can bypass other rooms in the building 12. The sound traveling through the ducts 16, 28, 30 and 32 can reach, at some point, acoustic frequency filter 24 (e.g., tunable Helmholtz resonators) and/or tunable active noise canceling sound source 26.

Figure 2:
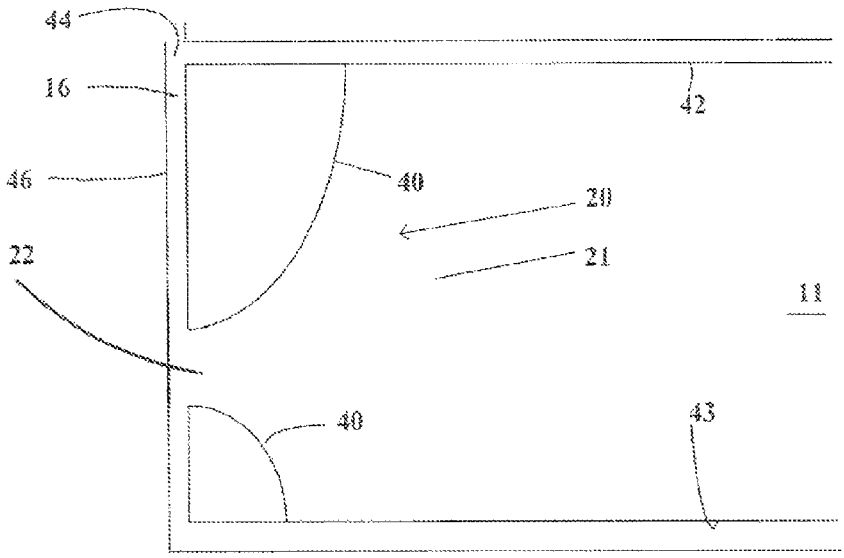
FIG. 2 shows a schematic cross-sectional view of a portion of the room shown in FIG. 1 with an acoustic absorber (acoustic fireplace) coupled to an acoustic waveguide, according to an embodiment of the present invention.

FIG. 2 shows a cross-sectional schematic view of a portion of the room 11 with acoustic fireplace 20 coupled to the acoustic waveguide 16, according to an embodiment of the present invention. In this embodiment, the horn-shaped fireplace 20 is a zero impedance horn having exponentially tapering walls 40. The acoustic fireplace 20 exponentially tapers from the mouth 21 located in the interior of room 11 to end or throat 22 of the horn connected to one of the acoustic waveguide ducts 16. In this embodiment, similar to the embodiment depicted in FIG. 1, the acoustic fireplace 20 can be attached to a wall of the room 11. For example, as shown in FIG. 2, the acoustic fireplace 20 is bordered on one side by ceiling 42 of room 11 and on the other side by floor 43 of room 11. As shown in FIG. 2, the acoustic waveguide duct 16 is acoustically coupled to the acoustic fireplace 20. The acoustic waveguide duct 16 extends through a gap 44 between the ceiling 42 of room 11 and a wall 46 of the room 10 shown in FIG. 1. This shows how the acoustic waveguide duct 16 is positioned behind the acoustically isolated room 11. The wall 46 can be covered with a sound insulating material so as to minimize sound leaks through wall 46 to the outside environment. The acoustic waveguide duct 16 can be acoustically coupled with other acoustic waveguide ducts 16 or acoustically coupled to acoustic waveguide duct 28 or 30 leading, for example, to the acoustic frequency filter 24 or the tunable anti-noise source 26 and ultimately to acoustic chimney 34, as shown in FIG. 1.

Figure 3:
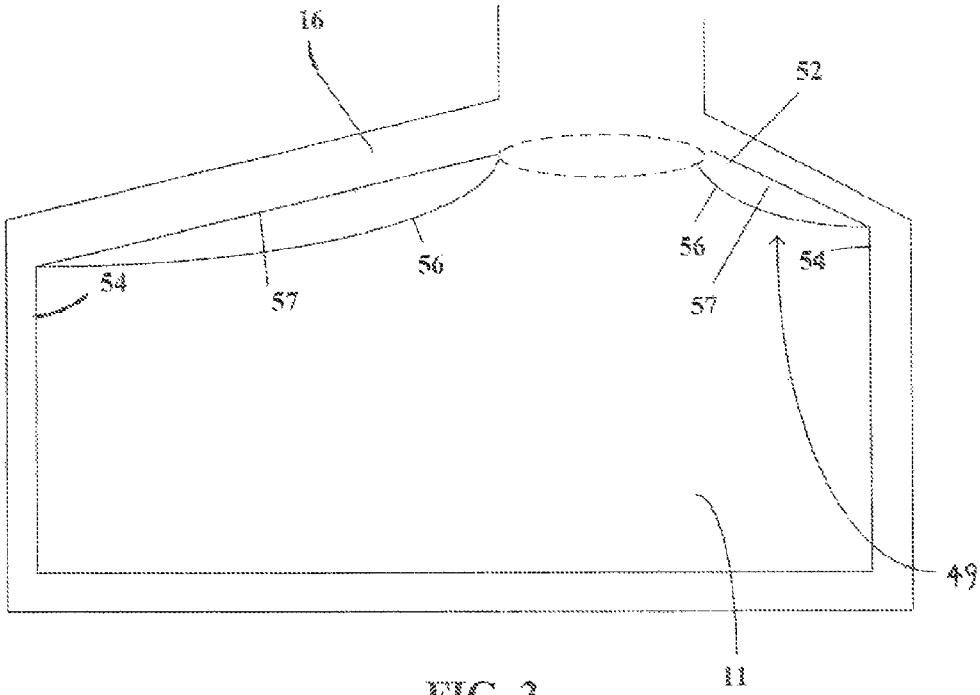
FIG. 3 shows a cross-section of an acoustic absorber (acoustic fireplace) positioned at a ceiling of a room, according to an embodiment of the present invention.

FIG. 3 shows a cross-section of an acoustic fireplace 49 attached to a ceiling 52 of room 11, according to an embodiment of the present invention. In this embodiment, the acoustic fireplace 49 is bordered on the sides by walls 54 of room 11. The acoustic fireplace 49 is a cone-shaped structure with either a linear tapering 57 or a horn-shaped structure with a non-linear tapering 56, such as an exponential tapering. The acoustic fireplace 49 is acoustically coupled to acoustic waveguide duct 16. The acoustic waveguide duct 16 can, in turn, be acoustically coupled to other acoustic waveguide ducts 16 or acoustically coupled to acoustic waveguide ducts 28 or 30 leading, for example, to the acoustic frequency filter 24 or the tunable anti-noise source 26 and ultimately to acoustic chimney 34, as shown in FIG. 1.

The height of acoustic chimney, i.e., the length of the acoustic duct 36, can be adjusted to reduce the sound intensity level at the exit from the chimney 34, i.e., at the mouth of the chimney 34. Indeed, radiated power at height h reaches the mouth of the chimney 36 with intensity proportional to $1/h^2$. Therefore, doubling the height of the chimney, i.e., the acoustic waveguide duct 36, will reduce sound intensity levels at the exit of the chimney 34 by a factor of 4.

Figure 4:
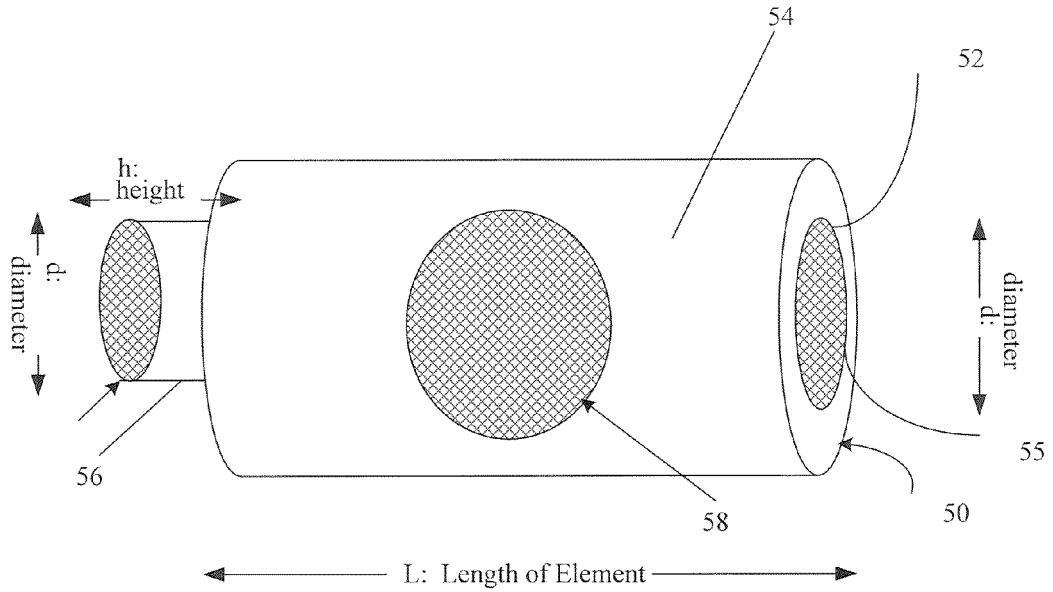
FIG. 4 depicts an acoustic waveguide duct element, according to an embodiment of the present invention.

In one embodiment, the acoustic ducts 16, 28, 30, 32 and/or 36 can be lined with acoustic material so as to increase sound absorption (e.g., sound absorption at low frequencies. The acoustic ducts 16, 28, 30, 32 or 36 can comprise a plurality of acoustic waveguide duct elements 50 that can be linked together to form the acoustic duct 16, 28, 30, 32 or 36. FIG. 4 depicts an acoustic waveguide duct element 50, according to an embodiment of the present invention. The acoustic waveguide duct element 50 can have a cylindrical shape with one or more channels 52 provided therein. The channel or channels 52 can be made by mechanically drilling, or made by carving material from two or more portions of a solid body 54 and then assembling the two or more portions of solid body 54 to form the channel 52. Alternatively, the channel 52 can be made during the fabrication of the solid body 54. For example, the solid body 54 can be provided with the channel 52 during an extrusion process (e.g., during the extrusion of plastic).

The solid body 54 can be made from a material that is acoustically neutral, such as foam, or it can be made from a material having tabulated absorption coefficients such as wood, fiber board, plastic and the like, or it can also be made from acoustically reflective materials, such as synthetic plastic compounds, metal (e.g., aluminum), or a combination of these materials. For example, the solid body 54 can be made from a laminated material including layers of various materials or from a composite material.

Although the channel 52 is shown in FIG. 4 as having a circular cross-section, the channel 52 can have any cross-section including a polygonal (e.g., triangular, square, rectangular, hexagonal, etc.) cross-section, an oval cross-section or a more complex cross-section such as a star-shaped cross-section or the like. The channel 52 can be open on both ends or can be closed on one of its ends. FIG. 4 shows a channel 52 having its extremity 55 open. Alternatively, the extremity 55 can be closed. In addition, although the channel 52 is shown in FIG. 4 having a straight cylindrical conformation, the channel 52 can also have curved or serpentine conformation or a zigzagging conformation, or a combination of two or more of these conformations.

A surface of channel 52 or a portion of the surface can be lined with an acoustic material (acoustic liner). A thickness of the acoustic material can be selected according to desired acoustic effects. The acoustic material can be manufactured from a material having a low absorption coefficient or high absorption coefficient depending on the sought application. For applications requiring scattering and more absorption, the acoustic can be manufactured from a material having a high absorption coefficient. A material that can be used as an acoustic liner is for example sound absorbing vinyl (with or without an absorbent fill like Dacron, closed cell foam, or cotton). A surface of channel 52 can also be provided with a certain surface texture to increase or decrease sound reflection, sound diffraction and/or sound diffusion.

The acoustic waveguide duct element 50 can also be provided with a neck portion 56. The neck portion 56 can be an integral part of the solid body 54 or a portion that can be attached to the solid body 54. The neck portion 56 can extend with height h and an external diameter d away from the solid body 54. The diameter of the neck 56 can be the same as a diameter of channel 52. The neck 56 can be used to connect the acoustic waveguide duct element 50 to a channel of another acoustic waveguide duct element, as shown in detail in FIG. 5. The acoustic waveguide duct element 50 can also be provided with a lateral opening 58. The lateral opening 58 can be used to connect another acoustic waveguide duct element to the acoustic waveguide duct element 50. In this way, for example, two acoustic waveguide duct elements 50 can be connected at a certain angle (e.g., about 90 deg.) respective to each other.

In addition, the element 50 can also be used as an acoustic frequency filter 24 (e.g., a Helmholtz resonator) with appropriate selection of various parameters including the dimension of the neck, the dimension of the cavity, i.e., channel 52, etc. In this case the acoustic waveguide duct element 50 can be closed at extremity 55. Furthermore, two lateral openings 58 can be provided in the element 50 so as to connect, for example, the duct 30 and duct 36 to the element 50. The neck portion 56 of the element 50 can be used to connect, for example, duct 32 to the element 50.

Figure 5:
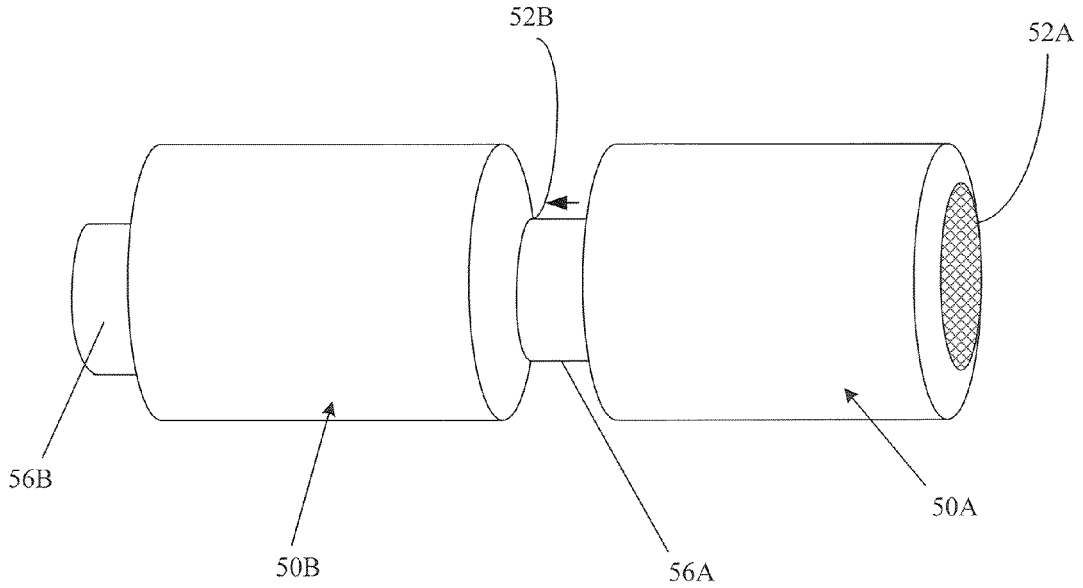
FIG. 5 shows a schematic view of two acoustic waveguide duct elements provided with external connecting portions or necks, respectively, for adjoining the two acoustic waveguide duct elements, according to an embodiment of the present invention.

FIG. 5 shows a schematic view of two acoustic waveguide duct elements 50A and 50B provided with external connecting portions or necks 56A and 56B, respectively, for adjoining the two acoustic waveguide duct elements 50A and 50B, according to an embodiment of the present invention. For example, the connecting portion (neck) 56A can be used to connect two acoustic channels 52A and 52B provided in the acoustic waveguide duct elements 50A and 50B, as illustrated in FIG. 5. This can be accomplished by inserting the external connecting portion (neck) 56A into the channel 52B as illustrated by the arrow in FIG. 5 or, alternatively, inserting the external connecting portion (neck) 56B into the channel 52A. In this way, a plurality of acoustic waveguide duct elements can be mounted in series to form the acoustic waveguide duct 16, 28, 30, and/or 36.

Figure 7A:
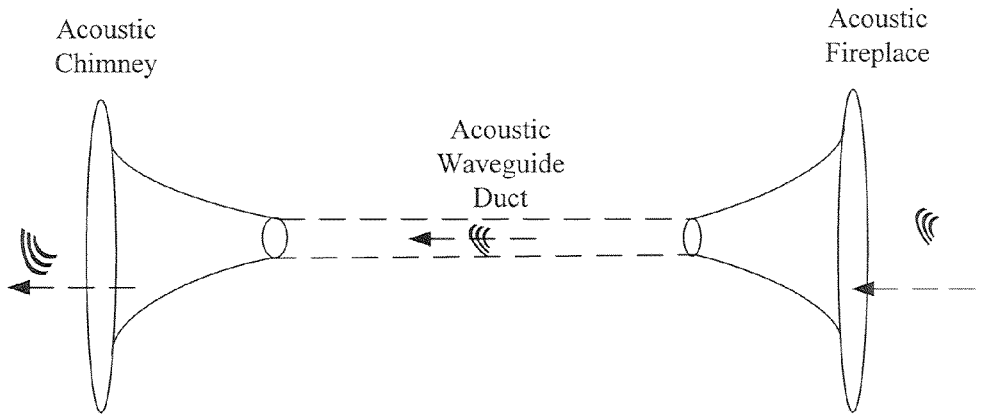
FIGS. 7A and 7B show examples of dual exponential surface acoustic absorber and acoustic radiator connected via an acoustic waveguide duct, according to an embodiment of the present invention.
Figure 7B:
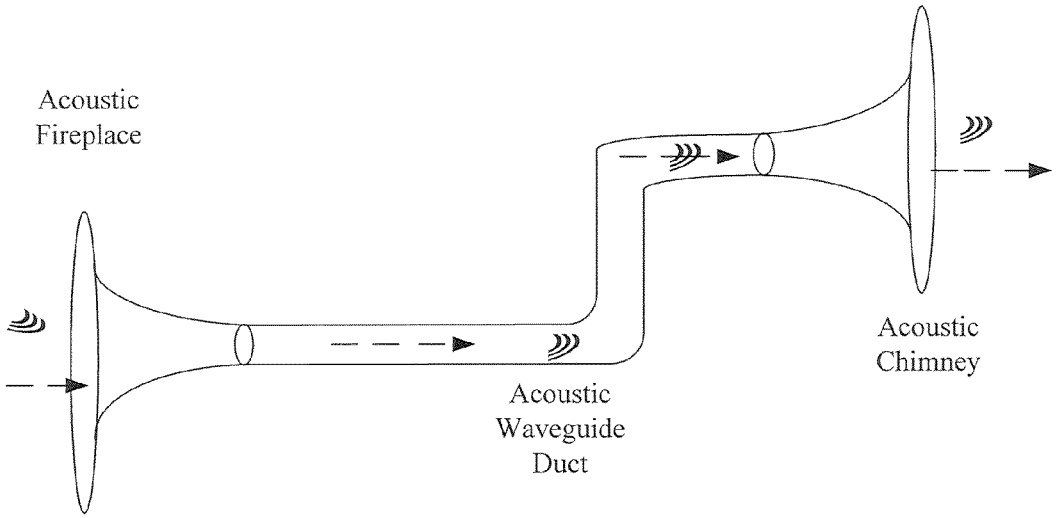
Figure 8A:
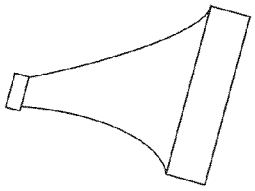
FIG. 8A is schematic lateral view of an acoustic absorber (acoustic fireplace) and/or an acoustic radiator (acoustic chimney), according to an embodiment of the present invention.
Figure 8B:
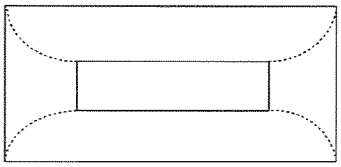
FIG. 8B is a schematic front view of the acoustic absorber (acoustic fireplace) or acoustic radiator (acoustic chimney) shown in FIG. 8A.
Figure 9:
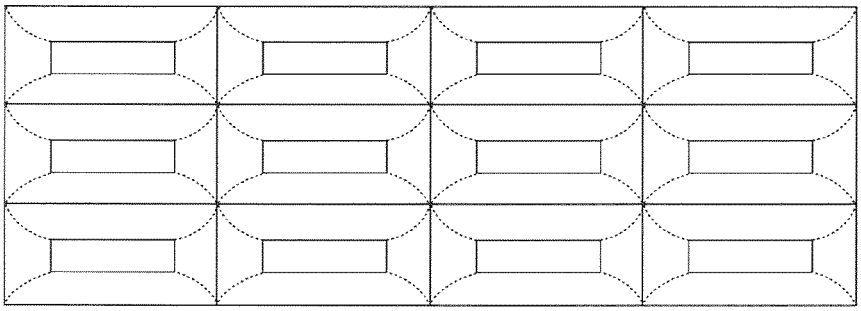
FIG. 9 illustrates a matrix of horns that can be used in an acoustic absorber (acoustic fireplace) and/or an acoustic radiator (acoustic chimney), according to an embodiment of the present invention.

The implementation of the acoustic fireplace and acoustic chimney specifies the frequencies of absorbance and or radiation, as well as the "best" frequencies for sound propagation through an acoustic waveguide duct. Tapering a duct opening can improve the impedance match between two connected volumes, i.e., between the duct and the room and between the duct and the open air. For example, a dual exponential surface absorber and radiator can be implemented. A dual exponential absorber and radiator includes an exponential surface absorber, i.e. acoustic fireplace and an exponential radiator, i.e., acoustic chimney. The exponential absorber and exponential radiator can be connected by an acoustic waveguide duct. FIGS. 7A and 7B show examples of dual exponential surface absorber and radiator connected via an acoustic waveguide duct. The exponential surface absorber (acoustic fireplace) can be disposed in a noisy room. The exponential radiator (acoustic chimney) can be disposed at a distal end of the acoustic waveguide duct in open air. From an acoustic circuit perspective, a dual exponential surface absorber/radiator can be seen as an acoustic waveguide similar to a giant speaking tube. At each end, the exponential surface absorber or the radiator acts as an acoustic transformer that can improve the impedance match between the outer and inner volumes. Although the acoustic fireplace and/or the acoustic chimney are depicted in FIGS. 7A and 7B having a circular cross-section, the acoustic fireplace or the acoustic chimney or both can have a polygonal cross-section, such as a rectangular cross-section as depicted in FIGS. 8A and 8B, an elliptical cross-section, or a more complex cross-section. FIG. 8A is schematic lateral view of the acoustic fireplace and/or chimney, according to an embodiment of the present invention. FIG. 8B is a schematic front view of the acoustic fireplace or acoustic chimney, according to an embodiment of the present invention. Furthermore, although the dual exponential surface absorber and radiator is described in the above paragraphs having one acoustic horn in the acoustic fireplace and one acoustic horn in the acoustic chimney, the acoustic fireplace or the acoustic chimney can include a plurality of horn arranged in a linear fashion or in a matrix fashion as depicted in FIG. 9. FIG. 9 illustrates how a set of smaller rectangular shaped exponential horns can be coupled together to form a matrix of horns that can be used in an acoustic fireplace and/or an acoustic chimney.

Figure 6:
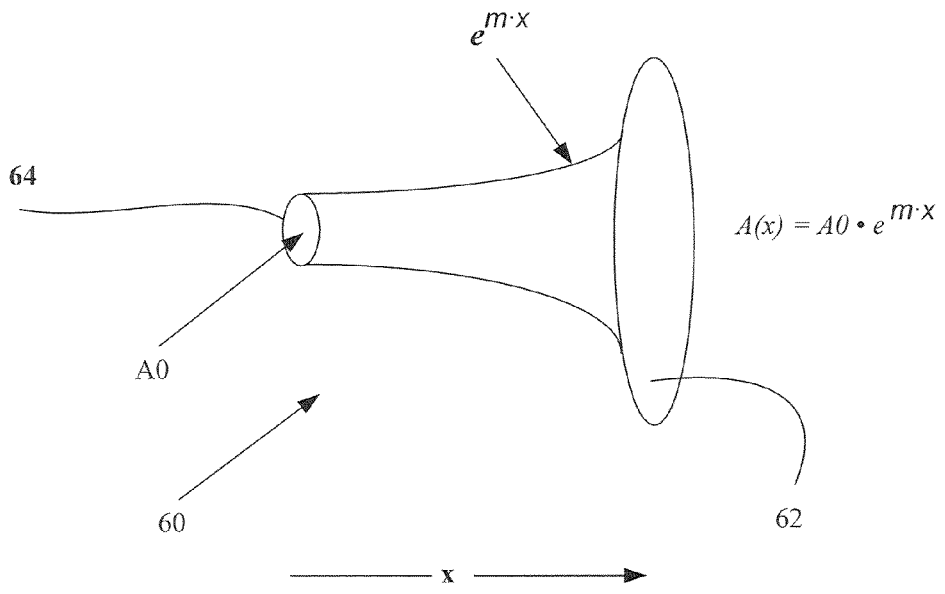
FIG. 6 depicts an example of an exponential tapered horn that can be used in an acoustic absorber (acoustic fireplace) or an acoustic radiator (acoustic chimney), or both, according to an embodiment of the present invention.

FIG. 6 depicts an example of an exponential tapered horn 60 that can be used in the acoustic fireplace 20 or acoustic chimney 34, or both. In the exponential tapered horn 60, the cross-sectional area of the horn is an exponential function of the distance from the throat 64 of the horn 60 to the mouth 62 of the horn 60. An exponential surface absorber is a duct where the cross-sectional area of the duct opening increases exponentially. Given length x of the horn and flaring constant m (in units of foot$^{-1}$). The cross-sectional area at a distance x from the throat 64 can be written as follows:

$$A(x)=A0\cdot e^{m\cdot x} \tag{1}$$

where A0 is the cross-sectional area at throat 64.

The solutions of the Webster Horn equation show that an exponential surface absorber/radiator propagates waves from its big open mouth to its throat in the duct (or vice versa) with lowest cutoff frequency $f_{cut}$ determined as follows:

$$f_{cut}=\frac{m\cdot c}{4\cdot\pi}=\frac{m\cdot 1130\frac{\text{ft}}{\text{sec}}}{4\cdot\pi}\approx 90\cdot\text{mHz} \tag{2}$$

Below the cutoff frequency $f_{cut}$, i.e. for frequencies $f<f_{cut}$, acoustic waves do not travel in the duct and stay in the room. Hence, exponential surface absorbers can be seen as high pass filters. Note that standing waves can form in the duct for frequencies $f>f_{cut}$, in the duct. The specific resonating frequencies can be controlled as desired, as will be explained in the following paragraphs. Acoustic waves propagating in the duct will go through the acoustic waveguide and radiate out through the acoustic chimney (or the radiating end of a dual exponential surface absorber). The resonating and propagating waves in the acoustic waveguide duct can be further dampened using Helmholtz resonators and mufflers.

Sound energy is transferred from the acoustic fireplace to the acoustic waveguide duct when the diameter D of the duct is equal to one or more wavelengths (nλ), where n is an integer. That is:

$$D=n\cdot\lambda=n\cdot\frac{c}{f} \tag{3}$$

and from equation (3), the frequency f can be extracted, as follows:

$$f=\frac{c\cdot n}{D}>\frac{c}{D} \tag{4}$$

For one wavelength (i.e., n=1), equation (4) can be rewritten as equation (5), as follows:

$$f>\frac{c}{2\cdot R} \tag{5}$$

where R is the radius of the duct.

A two wavelength rule states that "if an acoustic waveguide duct has a pressure disturbance with a wavelength larger than twice the waveguide duct's largest cross-sectional dimension, then only plane waves will propagate down the waveguide duct." Therefore, when the wavelength λ is twice the cross-sectional dimension D (i.e., when λ=2·D=4·R) energy starts being transferred through the acoustic waveguide duct. This leads to the following equation (6) at the frequency f.

$$f<\frac{C}{4R}\text{ and }R<\frac{c}{4\cdot f} \tag{6}$$

In a four wavelength rule, when the wavelength λ is 4 times the cross-sectional dimension D (i.e., when λ=4·D=8·R), sound energy starts to be transferred through the acoustic waveguide duct. This leads to the following equation (7):

$$f<\frac{c}{8\cdot R}\text{ and }R<\frac{c}{8\cdot f} \tag{7}$$

Using acoustic circuit arguments, 50% of the sound energy is propagated in the duct when the three wavelength rule is satisfied as follows:

$$\frac{2\pi}{\lambda_{max}}\cdot R=\frac{2\cdot\pi\cdot f_{min}}{c}\cdot r=1 \tag{8}$$

hence, the frequency can be deduced:

$$f_{min} = \frac{c}{2\cdot\pi\cdot R} = \frac{1130\frac{\text{ft}}{\text{sec}}}{2\cdot\pi\cdot R} \tag{9}$$

From equation (8) it can be noted that $$\lambda_{max}=2\pi\cdot R\approx 6\cdot R \tag{10}$$

and from equation (9) it can be noted that $$f_{min} = \frac{c}{2\cdot\pi\cdot R} \approx \frac{c}{6\cdot R} \tag{11}$$

These relationships can be used to provide optimum dimensions for the acoustic chimney and acoustic fireplace. For example, if the throat area of the acoustic fireplace and the acoustic chimney is known and is equal to area A0 and assuming a user wants an acoustic fireplace to absorb waves with frequencies greater or equal to about 50 Hz and the acoustic chimney to radiate waves with frequencies greater or equal to about 50 Hz, there are 2 unknowns, namely the radius of the mouth of the acoustic chimney and radius R of the mouth of the acoustic fireplace and the flaring parameter m. The radius R can be calculated using the 50% sound energy rule (equation (8)) and can also be calculated using the four wavelength rule (equation (7)).

$$R = \begin{cases} \frac{c}{2\cdot\pi\cdot f_{min}} = \frac{1130}{2\cdot\pi\cdot 50} = 3.6\text{ ft(50\% Sound Energy Rule)} \\ \frac{c}{8\cdot f_{min}} = 2.9\text{ ft(4 Wavelength Rule)} \end{cases}$$

Hence, the mouth area can be calculated using the result from the 50% sound energy rule, as follows $A(x)=\pi\cdot(3.6)^2=40.7$ sq ft.

By using the Webster Horn relationship (2), the parameter m can be determined.

$$m = \frac{f_{cut}}{90} = \frac{50}{90} \approx 0.56\text{ per ft}$$

Assuming an area A0=1 square foot at the throat of the acoustic fireplace/acoustic chimney, the distance from the mouth to the throat in the acoustic fireplace and the acoustic chimney can be calculated, as follows. Specifically, using equation (1), the following equation (12) can be derived.

$$x = \frac{1}{m}\ln\frac{A(x)}{A_0} = \frac{1}{m}\ln\frac{\pi R^2}{1} \tag{12}$$

Hence, with the value of the radius R calculated using the 50% sound energy rule or the value of the radius R calculated using the wavelength rule, the value of the distance from the mouth to the throat in the acoustic fireplace and the acoustic chimney can be determined.

$$x = \begin{cases} \frac{1}{m}\cdot\ln\left(\frac{\pi\cdot R^2}{A0}\right) = \frac{1}{0.56}\cdot\ln\left(\frac{40.7}{1}\right) = 6.72\text{ ft(50\% Sound Energy Rule)} \\ \frac{1}{m}\cdot\ln\left(\frac{\pi\cdot R^2}{A0}\right) = \frac{1}{0.56}\cdot\ln\left(\frac{24.6}{1}\right) = 5.72\text{ ft(Wavelength Rule)} \end{cases}$$

Therefore, in order to provide an acoustic fireplace that absorbs waves with frequencies greater or equal to about 50 Hz and to provide an acoustic chimney that radiates waves with frequencies greater or equal to about 50 Hz, for example, the dimensions of the acoustic fireplace and the acoustic chimney are selected such that the radius of the mouth of the acoustic fireplace/chimney is about 3 feet to 4 feet, the radius of the throat of acoustic fireplace/chimney is about 1 foot, and the distance between the throat and the mouth is about 6 feet to 7 feet.

Sound waves can propagate in the acoustic duct until hitting an impedance boundary. Reflections at both ends (zero pressure change) of the acoustic duct cause some waves to persist. The multiple reflections can lead to resonance frequencies. Resonance frequency for an acoustic duct of length L are calculated for a cylindrical shaped acoustic duct, as follows:

$$f_{res} = \frac{n\cdot c}{2\cdot L} = \frac{n\cdot 1130}{2\cdot L} \tag{13}$$

The above equation (13) can be rewritten as follows for a resonance wavelength.

$$\lambda_{res} = \frac{2\cdot L}{n} \tag{14}$$

For a cylindrical shaped duct with a tapered radius r, the resonance frequency is calculated using the following formula:

$$f_{res} = \frac{n\cdot c}{2\cdot(L+0.61\cdot r)} \tag{15}$$

In general, pressure creates standing waves with antinodes and nodes. The equation (14) can be generalized and the position of the nodes and antinodes can be calculated as follows.

$$x_{max\ pressure} = \frac{n\cdot\lambda}{2} \tag{16}$$

$$x_{min\ pressure} = \frac{n\cdot\lambda}{4} \tag{17}$$

For an acoustic duct open at both ends, there is a reflection at each opening. Boundary conditions imply that pressure is zero at both ends. Hence, the resonating frequencies are the same as for the closed tube. The resonance frequency and the resonance wavelength can be obtained with the following two equations.

$$f_{res} = \frac{n \cdot c}{2 \cdot L} = \frac{n \cdot 1130}{2 \cdot L} \tag{18}$$

$$\lambda_{res} = \frac{2 \cdot L}{n} \tag{19}$$

Acoustic pressure creates standing waves with antinodes and nodes in the middle of the acoustic duct. Since the resonance frequencies can be determined according to the geometry of the duct, the resonance frequencies can be attenuated by muffling techniques such as by using active resonance suppression techniques or using Helmholtz resonating techniques.

For example, in one embodiment, an acoustic waveguide duct can be coupled to a Helmholtz resonator whose tuning frequency depends on the dimensions of the acoustic waveguide duct and the Helmholtz resonator. Longer lengths, larger diameters, and larger volumes tune the absorption at lower frequencies. While, shorter lengths, smaller diameters, and smaller volumes tune the absorption at higher frequencies.

In relation to FIG. 4, as stated the element 50 can be used as a Helmholtz resonator with appropriate selection of various parameters including the dimension of the neck, the dimension of the cavity, i.e., channel 52, etc. The absorbing frequency of a "traditional" Helmholtz absorber is calculated as follows:

$$f(\text{Hz}) = \frac{c \cdot d}{4 \cdot \sqrt{\pi \cdot V \cdot h}}, \tag{20}$$

In equation (20), h is the height of the protruding connecting portion or neck 56. d is the inside diameter of the neck 56, V is the volume of the cavity of the channel 52 and c is the speed of sound. Hence, by changing the volume of the cavity of the channel, the height of the protruding neck 56 and/or the diameter of the neck 56, the Helmholtz resonator can be tuned to absorb specific frequency or frequencies.

Figure 10:
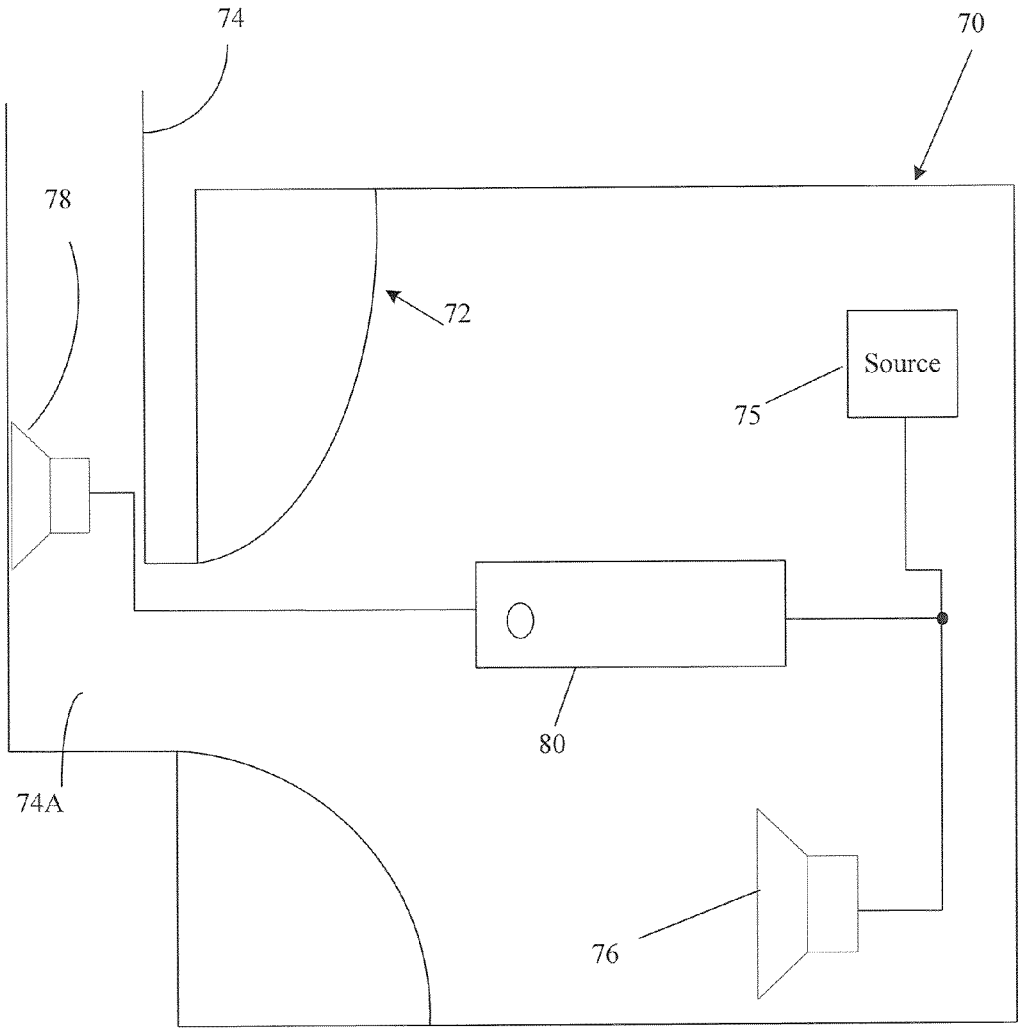
FIG. 10 depicts a schematic diagram for attenuating sound, according an embodiment of the present invention.

An acoustic waveguide duct can also be coupled to a sound generating device (e.g., loudspeaker) so as to obtain a system for attenuating or absorbing sound with certain frequencies. FIG. 10 depicts a schematic diagram for attenuating sound, according to an embodiment of the present invention. In this embodiment, a room or volume 70 is provided with a acoustic absorber structure or acoustic fireplace 72. The acoustic fireplace 72 is acoustically coupled to the acoustic waveguide duct 74. Inside the room 70 is located a first sound generating device (e.g., loudspeaker) 76. A second sound generating device (e.g. a loudspeaker) 78 is positioned inside the acoustic waveguide duct 74, for example at the entrance 74A of the acoustic waveguide duct 74, or in the vicinity of the acoustic waveguide duct 74 along a length of the acoustic waveguide duct 74. First sound generating device 76 is driven by signals from source 75 (such as a stereo system, television or the like). The same signal is provided to a phase controller or digital signal processing controller 80 including those devices that approximate one-, two-, or three-dimensional acoustic transfer functions. These devices use linear or non-linear algorithms, microphones, and speakers to generate a target sound so that the difference between the original sound source and the target sound is minimized. The phase controller or digital signal processing controller 80 is configured to delay the phase of the signal by a controllable amount and the delayed signal is provided to second sound generating device 78. In operation, sound emitted by the first sound generating device 76 is absorbed by the acoustic fireplace 72 and guided through the acoustic waveguide duct 74 to be released into air through an acoustic chimney (not shown). In order to attenuate the sound inside the acoustic waveguide duct 74, the phase of the sound emitted by the second sound generating device 78 is adjusted using the phase controller or digital signal processing controller 80 so as to be substantially opposite, i.e., 180°, of the phase of the sound from the first sound generating device 76 as it passes second generating device 78. This adjustment can be manual.

Figure 11:
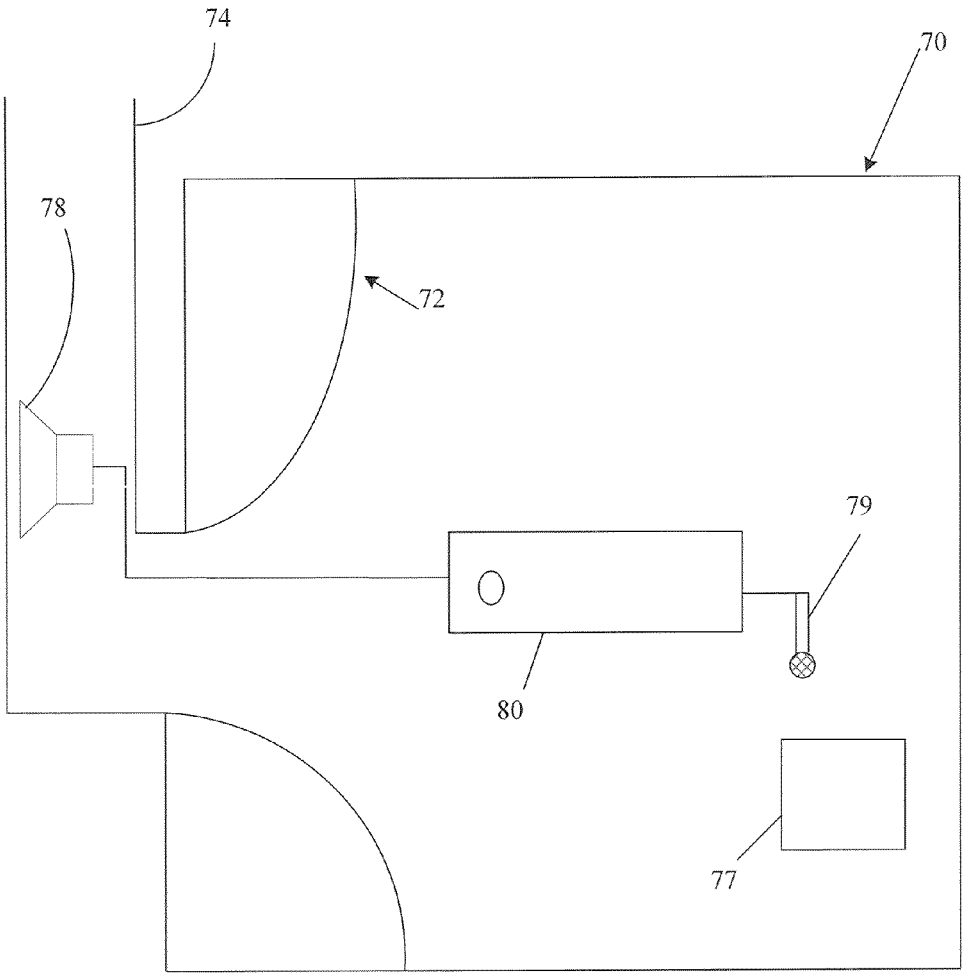
FIG. 11 depicts a schematic diagram for attenuating sound, according another embodiment of the present invention.

FIG. 11 depicts a schematic diagram for attenuating sound, according to another embodiment of the present invention. This embodiment is similar in many aspects to the embodiment described in the above paragraph. However, in this embodiment, the first generating device 76 can be a mechanical sound generating source 77 such as a fan, stereo system, television, or the like. A sound pickup device, such as a microphone, can be used to sense the sound emitted by the sound generating source 77. In this case, the second sound generating device 78 and the sound pickup device 79 are in communication with the phase controller or digital signal processing controller 80 including those devices that approximate one-, two-, or three-dimensional acoustic transfer functions. These devices use linear or non-linear algorithms, microphones, and speakers to generate a target sound so that the difference between the original sound source and the target sound is minimized. The phase controller or digital signal processing controller 80 is configured to delay the phase of the sound emitted by the sound source 77 and detected using sound pickup device 79 by an adjustable amount and to control the second sound generating device 78 to generate a sound having a phase substantially opposite the phase of the sound generated by the sound source 77 as it passes second generating device 78. Although the sound pickup device 79 is shown in FIG. 11 positioned in the vicinity of the sound source 77, the sound pickup device 79 can be disposed anywhere inside the room 70 or inside the acoustic fireplace 72 (e.g., at the throat of the acoustic fireplace 72) or inside the acoustic waveguide duct 74. In operation, similar to the embodiment depicted in FIG. 10, sound emitted by the sound source 77 is absorbed by the acoustic fireplace 72 and guided through the acoustic waveguide duct 74 to be released into air through an acoustic chimney (not shown). In order to attenuate the sound inside the acoustic waveguide duct 74, the phase of the sound emitted by the second sound generating device 78 is delayed using the phase controller or digital signal processing controller 80 so as to be substantially opposite, i.e., 180°, to the phase of the sound emitted by sound source 77 picked up by the sound pick up device 79 as such sound passes second generating device 78. This delay can be adjusted manually to achieve cancellation.

Figure 12:
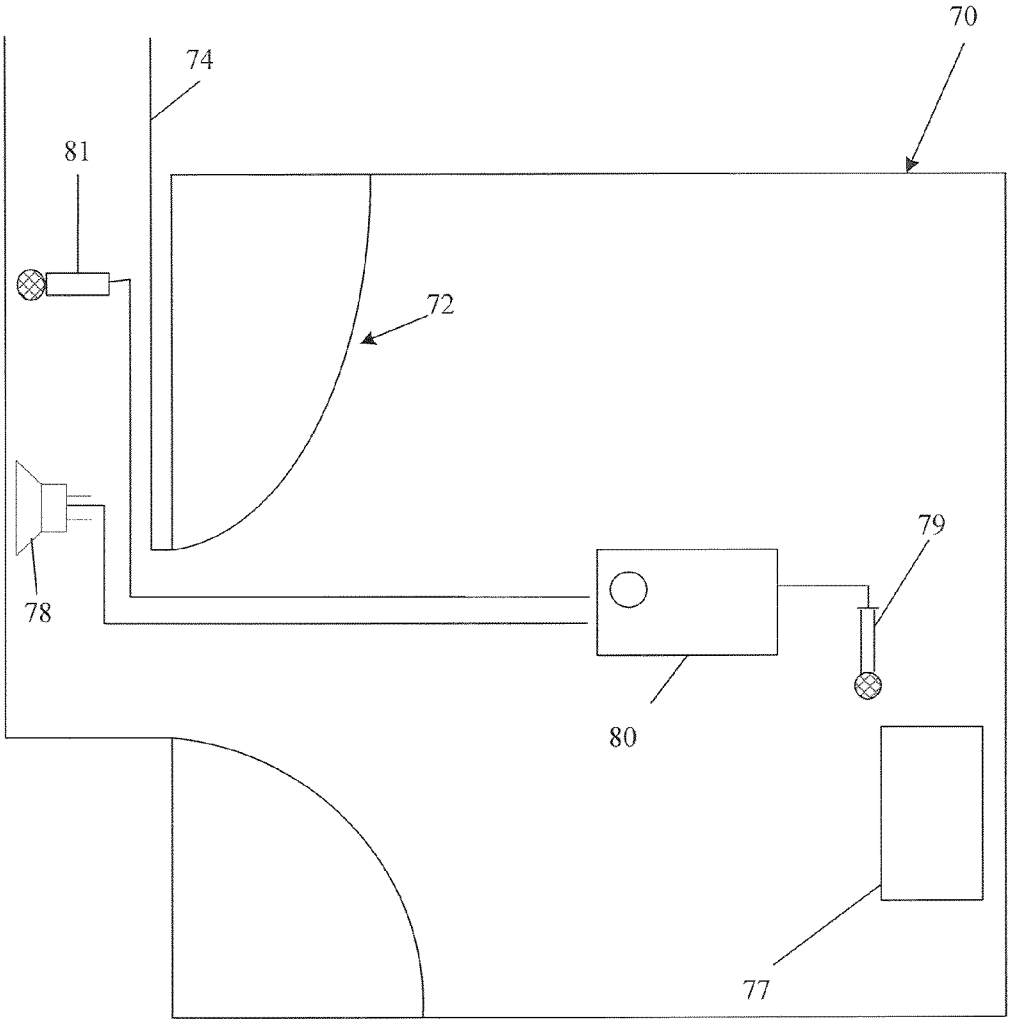
FIG. 12 depicts a schematic diagram for attenuating sound in an active adaptive system, according an embodiment of the present invention.

FIG. 12 depicts a schematic diagram for attenuating sound in an active adaptive system, according to yet another embodiment of the present invention. This embodiment is similar in many aspects to the embodiment described in the above paragraphs. However, in this embodiment, in addition to the sound pickup device 79, another sound pickup device 81 is disposed inside the acoustic waveguide duct 74 or in the vicinity of the acoustic waveguide duct 74 along a length of the acoustic waveguide duct 74. Although, two sound pickup devices are shown in FIG. 12, more sound pickup devices can be employed. The sound pickup device 81 is also in communication with the phase controller or digital signal processing controller 80. Similarly to the embodiment depicted in FIG. 11, although, the sound pickup device 79 is shown in FIG. 11 positioned in the vicinity of the sound source 77, the sound pickup device 79 can be disposed anywhere inside the room 70 or inside the acoustic fireplace 72 (e.g., at the throat of the acoustic fireplace 72) or inside the acoustic waveguide duct 74. In operation, sound emitted by the sound source 77 is absorbed by the acoustic fireplace 72 and guided through the acoustic waveguide duct 74 to be released into air through an acoustic chimney (not shown). In order to attenuate the sound inside the acoustic waveguide duct 74, the phase of the sound emitted by the second sound generating device 78 is adjusted using the phase controller or digital signal processing controller 80 so as to be substantially opposite, i.e., 180°, to the phase of the sound emitted by sound source 77 picked up by the sound pickup device 79 as such sound passes second sound generating device 78. The sound pickup device 81 provides a feedback on the level of sound that is detected downstream of the sound generating device 78 to the phase controller or digital signal processing controller 80. In this embodiment, the phase controller or digital signal processing controller 80 is automatically adjusted using the feedback signal from the sound pickup device 81 until a minimum of sound level detected by the sound pickup device 81 is attained.

However, sound pickup devices or microphones may not be needed if the loudspeaker is not part of an active adaptive system. In this simpler case, noise canceling relies on subjective procedures. Low frequency sound produced in the room by a sound generating device from a recording or film, etc. can be simultaneously transmitted to one or more control loudspeakers located internal or external to an acoustic duct. The audio signals sent to the one or more control loudspeakers may or may not be reversed in phase. The phase is a parameter that can be used in the noise canceling tuning procedure. Phase differences between two identical sound sources depend on a distance between the two sound sources. Hence, the physical location of the one or more loudspeakers along the waveguide can affect the phase of the canceling sound. As a result, placement or positioning of the one or more loudspeakers along the waveguide can be used as a tuning parameter for attenuating or dampening the amount of sound. The attenuation of sound can be qualitatively evaluated using the perception of a listener standing outside the room and outside the acoustic duct.

In addition, to sound mitigation, the present sound dampening system can also be used in reducing distortion in sound systems and home theaters. In most sound systems, low frequency transverse waves (that give a subwoofer effect) interfere and superimpose on the next set of waves, thus increasing the amplitude and distorting the pure tones in the room. Hence by using appropriately dimensioned acoustic absorber and radiator, the distortion effect can be controlled.

While various embodiments of the present invention have been described above, it should be understood that they have been presented by way of example, and not limitation. It will be apparent to persons skilled in the relevant art(s) that various changes in form and detail can be made therein without departing from the spirit and scope of the present invention. In fact, after reading the above description, it will be apparent to one skilled in the relevant art(s) how to implement the invention in alternative embodiments. Thus, the present invention should not be limited by any of the above-described exemplary embodiments.

For example, while the present acoustic device is described herein above for application in a room, such as a room of a house or a building, or a theater, it must be appreciate that the acoustic device can be used in any enclosed volume such as, but not limited to, a subway station, a bus depot, an airline terminal, a recreational vehicle (RV) or in a camper or mobile-home.

Moreover, the method and device of the present invention, like related devices and methods used in acoustics are complex in nature, are often best practiced by empirically determining the appropriate values of the operating parameters, or by conducting computer simulations to arrive at best design for a given application. Accordingly, all suitable modifications, combinations and equivalents should be considered as falling within the spirit and scope of the invention.

In addition, it should be understood that the figures, are presented for example purposes only. The architecture of the present invention is sufficiently flexible and configurable, such that it may be utilized in ways other than that shown in the accompanying figures.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope of the present invention in any way.

What is claimed is:

1. An acoustic structure for dampening sound generated by a sound source in an enclosed volume, comprising: an acoustic absorber attached to the enclosed volume and having a horn-shaped acoustic element for absorbing the sound generated by the sound source in a certain frequency range, wherein a cross-sectional area of the acoustic element exponentially tapers and decreases with a distance from a mouth of the acoustic element to a throat of the acoustic element: an acoustic radiator having an acoustic element for radiating sound, the acoustic radiator disposed outside the enclosed volume; and one or more acoustic waveguide duets at least partially lined with acoustic absorbing material and configured to acoustically couple the acoustic absorber and the acoustic radiator, wherein a portion of sound inside the enclosed volume is absorbed by the acoustic absorber, dampening the sound in the enclosed volume; wherein the absorbed portion of the sound, at an absorbed sound level is propagated through the one or more acoustic waveguide ducts to the acoustic radiator; and wherein the acoustic absorbing material at least partially lining the one or more acoustic waveguide ducts dampens the portion of the sound absorbed by the acoustic absorber and propagated in the one or more acoustic waveguide ducts resulting in a radiated sound level at the acoustic radiator that is less than the absorbed sound level at the acoustic absorber; further comprising an anti-noise source acoustically coupled to the one or more acoustic waveguide ducts and configured for learning and then generating a cancelling sound 180° out of phase with a first sound generated by a noise source present in the volume, the cancelling sound generated to attenuate and/or substantially cancel the first sound in the one or more acoustic waveguide ducts.

2. The structure of claim 1, wherein the volume is a room.

3. The structure of claim 1, wherein the acoustic absorber includes a plurality of acoustic elements which are arranged in a linear or matrix fashion.

4. The structure of claim 1, wherein the acoustic radiator includes a plurality of acoustic elements which are arranged in a linear or matrix fashion.

5. The structure of claim 1, wherein the acoustic element of the acoustic absorber is configured to propagate sound waves from the mouth to the throat when a frequency is greater than a cutoff frequency, the cutoff frequency being equal to approximately 90 m Hz, where m is a flaring parameter in units per foot.

6. The structure of claim 1, wherein a size of the mouth and the size of the throat are selected so that the acoustic absorber absorbs sounds of frequencies greater than a desired cutoff frequency and the acoustic radiator radiates the sounds of frequencies greater than the desired cutoff frequency.

7. The structure of claim 1, wherein the acoustic frequency filter is acoustically coupled to the acoustic radiator via the one or more acoustic waveguide ducts.

8. The structure of claim 1, further comprising an acoustic frequency filter acoustically coupled to the one or more acoustic waveguide ducts.

9. The structure of claim 1, wherein the acoustic radiator and the acoustic absorber are configured so as to minimize or substantially eliminate acoustic distortion effects in the volume.

10. The structure of claim 1, wherein the one or more acoustic waveguide duct is positioned between a wall of a first room and a wall of a second room within the first room.

11. The structure of claim 10, wherein the one or more acoustic waveguide extends through a gap between a ceiling of the second room and the floor of the first room.

12. The structure of claim 10, wherein at least a portion of the wall of the first room is covered with sound insulating material.

13. The structure of claim 10, wherein the one or more acoustic elements of the acoustic absorber is located inside the second room and the one or more cone-shaped acoustic elements of the acoustic radiator is located outside the first room.

14. The structure of claim 13, wherein the one or more acoustic elements of the acoustic absorber is bordered on one side by the ceiling of the second room and on another side by a floor of the second room.

15. The structure of claim 13, wherein the one or more acoustic elements of the acoustic absorber is attached to a ceiling of the second room and is bordered by vertical walls of the second room.

16. The structure of claim 1, wherein the one or more acoustic waveguide ducts comprises a plurality of linked waveguide duct elements.

17. The structure of claim 16, wherein the one or more of the plurality of waveguide duct elements includes a solid body having one or more channels therethrough.

18. The structure of claim 17, wherein the solid body has a lateral opening configured to receive a neck portion of one acoustic waveguide duct element.

19. The structure of claim 17, wherein the one or more channels is open on both ends or closed on one end and open on the other end.

20. The structure of claim 17, wherein the one or more channels is lined with an acoustic liner.

21. The structure of claim 17, wherein one or more acoustic waveguide duct element in the plurality of acoustic waveguide duct elements includes a neck portion.

22. The structure of claim 21, wherein the neck portion extends from the solid body, wherein the neck portion is configured to connect one acoustic waveguide duct element to another acoustic waveguide duct element.

23. The structure of claim 1, further comprising an acoustic frequency filter acoustically coupled to the one or more acoustic waveguide ducts.

24. The structure of claim 23, wherein acoustic frequency filter is a frequency tunable Helmholtz resonator.

25. The structure of claim 23, wherein the acoustic frequency filter is configured to attenuate acoustic resonance frequencies in the one or more acoustic waveguide ducts.

26. The structure of claim 1, wherein the anti-noise source is positioned inside or in the vicinity of the one or more acoustic waveguide ducts.

27. The structure of claim 26, wherein the anti-noise source is controlled by a phase controller or digital signal processing controller configured to sense and learn the phase of the first sound emitted by the noise source and to control the anti-noise source to generate the cancelling sound.

28. The structure of claim 27, further comprising a sound pickup device disposed inside the volume and configured to detect, learn, and communicate the first sound emitted by the sound source to the phase controller or digital signal processing controller.

29. The structure of claim 28, further comprising one or more sound pickup devices disposed inside or in a vicinity of the one or more acoustic waveguide ducts, the one or more sound pickup devices in communication with the phase controller or digital signal processing controller and configured to provide a feedback to the phase controller or digital signal processing controller on a level of sound detected.

30. A method of attenuating sound in a volume, comprising: disposing an acoustic absorber in or attached to the volume axed having one or more horn-shaped acoustic elements for absorbing sound in a certain frequency range and at an absorbed sound level thereby attenuating the sound in the volume, wherein a cross-sectional area of the one or more acoustic elements exponentially tapers and decreases with a distance from a mouth of the one or more acoustic elements to a throat of the one or more acoustic elements; disposing an acoustic radiator having one or more acoustic elements for radiating sound outside the volume; and coupling acoustically the acoustic absorber and the acoustic radiator using one or more acoustic waveguide ducts at least partially lined with acoustic absorbing material in order to absorb a portion of sound absorbed in the volume by the acoustic absorber at the absorbed sound level, and propagating the absorbed sound through the one or more acoustic waveguide ducts to the acoustic radiator; wherein the acoustic absorbing material at least partially lining the one or more acoustic waveguide ducts attenuates the sound propagated therein resulting in a radiated sound level at the acoustic radiator that is less than the absorbed sound level at the acoustic absorber; further comprising an anti-noise source acoustically coupled to the one or more acoustic waveguide ducts and configured for learning and then generating a cancelling sound 180° out of phase with a first sound generated by a noise source present in the volume, the cancelling sound generated to attenuate and/or substantially cancel the first sound in the one or more acoustic waveguide ducts.

31. The method of claim 30, further comprising coupling acoustically an acoustic frequency filter to the one or more acoustic waveguide ducts.

32. The method of claim 30, further comprising coupling a phase tunable anti-noise source to the one or more acoustic waveguide ducts.

33. The method of claim 32, further comprising tuning the phase tunable anti-noise source to substantially attenuate sound waves in the one or more acoustic waveguide ducts.

34. The method of claim 33, wherein the tuning includes generating a sound having a phase substantially opposite a phase of a sound generated in the volume.

35. An acoustic structure for dampening sound in a volume comprising: an acoustic absorber disposed in or attached to the volume and having one or more horn-shaped acoustic elements for absorbing sound in a certain frequency range and at an absorbed sound level, thereby dampening the sound in the volume, wherein a cross-sectional area of the one or more acoustic elements exponentially tapers and decreases with a distance from a mouth of the one or more acoustic elements to a throat of the one or more acoustic elements; an acoustic radiator for radiating sound, the acoustic radiator disposed outside the volume one or more acoustic waveguide ducts configured to acoustically couple the acoustic absorber and the acoustic radiator and propagate the sound absorbed inside the volume at the absorbed sound level by the acoustic absorber to the acoustic radiator; an acoustic frequency filter acoustically coupled to the one or more acoustic waveguide ducts and configured to attenuate acoustic resonance frequencies of the absorbed soured; wherein the attenuated acoustic resonance frequencies of the absorbed sound effected by the acoustic filter dampens the sound propagated in the one or more acoustic waveguide ducts resulting in a radiated sound level at the acoustic radiator that, is less than the absorbed sound level at the acoustic absorber; further comprising an anti-noise source acoustically coupled to the one or more acoustic waveguide ducts and configured for learning and then generating a cancelling sound 180° out of phase with a first sound generated by a noise source present in the volume, the cancelling sound generated to attenuate and/or substantially cancel the first sound in the one or more acoustic waveguide ducts.

* * * * *